US006105204A

United States Patent [19]

Scharwat

[11] Patent Number: 6,105,204

[45] Date of Patent: Aug. 22, 2000

[54] SURFACE TRACKING JET CLEANING DEVICE

[76] Inventor: Frank E. Scharwat, 901 W. State Rte. 20, Coupeville, Wash. 98239

[21] Appl. No.: 08/725,644

[22] Filed: Oct. 15, 1996

[51] Int. Cl.[7] ..... A47L 7/00

[52] U.S. Cl. ..... 15/322; 15/354; 15/322; 239/288; 239/754

[58] Field of Search ..... 15/322, 354; 239/288, 239/754; 401/48

[56] References Cited

U.S. PATENT DOCUMENTS

| | | | |
|---|---|---|---|
| 3,168,247 | 2/1965 | Schild . | |
| 3,380,658 | 4/1968 | Stasz et al. . | |
| 3,522,909 | 8/1970 | Arant . | |
| 3,831,849 | 8/1974 | Studinger . | |
| 3,997,114 | 12/1976 | Hewett . | |
| 3,998,387 | 12/1976 | Maasberg | 15/354 |
| 4,015,613 | 4/1977 | Papworth . | |
| 4,112,535 | 9/1978 | Wild et al. . | |
| 4,220,170 | 9/1980 | Hebert et al. . | |
| 4,585,168 | 4/1986 | Even et al. . | |
| 4,777,972 | 10/1988 | Adam . | |
| 5,259,556 | 11/1993 | Paige et al. . | |
| 5,265,805 | 11/1993 | Artenian | 239/754 |
| 5,397,054 | 3/1995 | Ziegs . | |
| 5,449,303 | 9/1995 | McLeod | 239/754 |

*Primary Examiner*—John J. Calvert
*Assistant Examiner*—Robert H. Muromoto, Jr.
*Attorney, Agent, or Firm*—Graybeal Jackson Haley LLP

[57] ABSTRACT

A jet cleaning device for connection to one or more liquid pumps which includes a telescoping ram having a pivotally mounted cleaning head. The telescoping ram may be mounted on a manlift or a self propelled cart and has extension compensators which maintain a constant distance between the cleaning head and the surface to be cleaned. The jetting head or heads inside the cleaning head are adjustable so as to control the standoff distance and the jetting pattern. The perimeter of the base of the cleaning head shroud is also fitted with a brush which reduces the amount of misting produced by the operation of the device.

8 Claims, 2 Drawing Sheets

SURFACE TRACKING JET CLEANING DEVICE

FIELD OF THE INVENTION

The present invention relates to a jet cleaning device and more particularly a surface tracking jet cleaning device which maintains a constant distance between itself and the surface to be cleaned.

BACKGROUND OF THE INVENTION

Jet cleaning devices are used to remove materials from surfaces either in preparation for the application of a coating or as part of routine maintenance. These devices are often used to remove coatings such as paints, primers, and varnishes from common substrate materials such as steel, aluminum or concrete. There are numerous well known applications for jet cleaning devices in the manufacture and maintenance of aircraft, automobiles, ships, pipes, buildings, bridges, storage tanks, structures, etc.

In general, jet cleaning devices are comprised of one or more pumps which supply a jet of liquid, generally water, at high pressure, to the surface to be cleaned. The high pressure liquid is directed at the surface to be cleaned through one or more nozzle devices which produce a jet or jets which are guided along the surface to be cleaned. In the prior art, the jet producing device is generally mounted to, or part of, a hand held device such as a jetting gun or lance. In some cases, multiple nozzle devices are rotated by the force of the jet stream or by a drive assembly in order to clean a larger surface area than would be cleaned by a single jet stream. The weight and/or thrust produced by larger rotational multiple nozzle devices prevents utilization in a hand held format.

The efficiencies of the prior art devices are dependent upon several well known factors. In order to obtain optimum cleaning or coatings removal efficiencies, the distance from the jet producing nozzle(s) to the surface to be cleaned (known as stand-off distance) must be closely controlled. Also, in order to obtain optimum cleaning or coatings removal efficiencies, the speed at which the jet producing nozzles are guided along the surface to be cleaned (known as nozzle pass rate) must be closely controlled. The prior art devices are limited in their ability to control the standoff distance and the rate at which the jet producing nozzles are moved along the surface to be cleaned.

SUMMARY OF THE INVENTION

There is a need for a jet cleaning device with higher production rates and greater efficiency and increased automation than present jet cleaning devices. This may be achieved by increasing the control over the standoff distance and the nozzle pass rate along with higher pressure, higher flow rate, or a combination of either. There is a further need for a jet cleaning device which eliminates the necessity of guiding the jet streams at the surface to be cleaned by means of a hand held device. There is a further need for a device which allows the jetting nozzles to be directed at a surface in any global orientation, whether the surface is vertical, horizontal or overhead, while attached to a self propelled vehicle such as a manlift or powered cart. There is a further need for a device which allows the distance from the jet producing nozzle(s) to the surface to be cleaned to be strictly controlled and adjusted automatically. There is a further need for a device which provides a means by which the jet producing nozzles can be guided along curved surfaces, concave or convex, while maintaining a constant distance from the jet producing nozzle(s) to the surface. There is a further need for a device which would allow a single operator the ability to simultaneously operate multiple jetting heads which may be powered by multiple pumping systems. There is a further need for a device which provides a means by which vacuum can be utilized to remove both the coatings which have been removed as well as the water which has been ejected from the jet producing nozzles.

The present invention is intended to satisfy these needs by providing a means by which multiple jetting devices can be attached to a self propelled device, such as a manlift, to perform surface cleaning or coatings removal while controlling the distance from the jet producing nozzle(s) to the surface to be cleaned and the nozzle pass rate. The use of a gimbal allows the cleaning head to pivot about a central axis. This allows the jetting head to follow the contours of the surface to be cleaned. The use of casters in combination with adjustable jetting nozzles and a force compensated telescoping ram allows the present invention to maintain a constant standoff distance. The invention provides a means to attach a vacuum whereby the waste water and removed coatings can be removed or recycled.

DETAILED DESCRIPTION OF THE INVENTION

Figure 1:
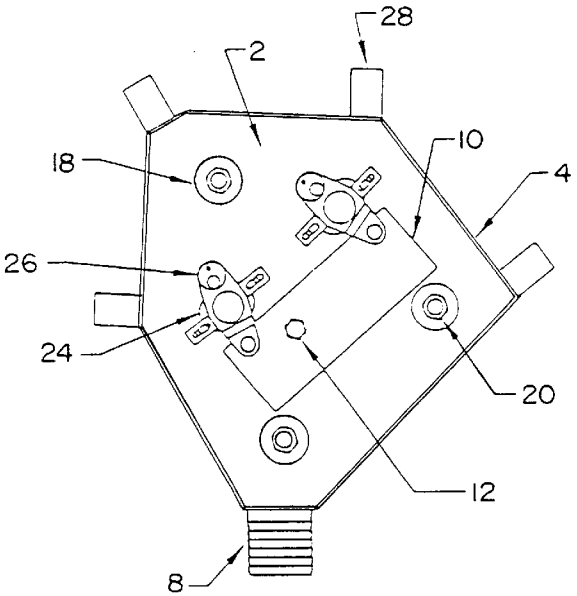
FIG. 1 is a top view of the cleaning head of the jet cleaning device of the present invention.
Figure 3:
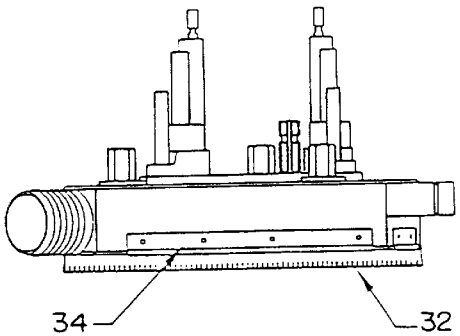
FIG. 3 is a side view of the cleaning head.
Figure 2:
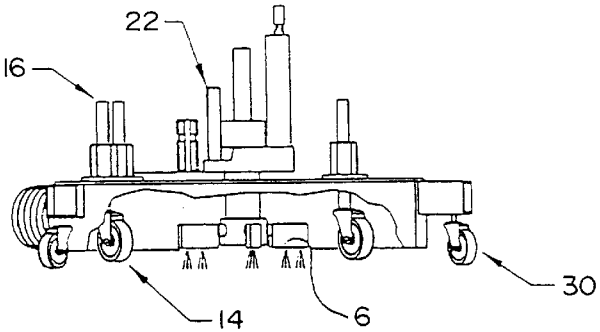
FIG. 2 is a cut away side view of the cleaning head.

Referring to FIGS. 1, 2 and 3, the cleaning head 2 has a shroud 4 onto which multiple jetting heads 6 are mounted. The shroud 4 is shaped such that the flow of water from each jetting head 6 is funneled down to the drain 8 which can also be utilized as a vacuum attachment point. Without the aid of a pump or vacuum machinery, the waste water and removed material will flow downward through the drain 8 due to gravity and away from the jetting heads 6. With the aid of either a pump or a vacuum attached to the drain 8, the waste stream can be more efficiently removed and delivered to a treatment or recycling system. A central stiffening plate 10 is attached to the top surface of the shroud upon which is mounted a splined shaft 12 to which the gimbal 46 of telescoping ram 40 in FIG. 4 will be attached as shown in FIG. 5.

In FIGS. 1, 2 and 3, the central casters 14 are mounted on the ends of central caster studs 16. The central caster studs 16 are threaded which allows the height of the central casters 14 to be varied. Nut stiffening plates 18 are mounted to the top of the shroud 4 beneath the central caster securing nuts 20 that are attached to the top surface of the central stiffening plate 10 in order allow the adjustment of threaded central caster studs 16 to which central casters 14 are attached. The central casters 14 allow the shroud 4 and its attached jetting heads 6 to roll in any direction along the surface to be cleaned. In the preferring embodiment, the central casters 14 are rollable wheels. In an alternative embodiment, skids are used for the central casters.

Each jetting head 6 is affixed to the shroud 4 by means of a threaded jetting head stud 22 which allows the precise control of the distance from the jetting heads 6 to the surface to be cleaned. Each jetting head stud 22 passes through a jetting head aperture 24 in the top surface of the shroud 4. Hold down clamps 26 are utilized in order to prevent the rotation of the jetting heads 6 upon their jetting head studs 22.

The jetting heads 6 are configured such that their patterns of cleaning and/or coatings removal overlap so that there is neither a gap not excessive overlap between their patterns. This is critical to the efficiency of the system in that an excessive amount of overlap between the jetting heads 6 would create a loss of production and therefore a reduction of efficiency. If there is a gap between the cleaning and/or coatings removal pattern of the jetting heads 6, there will also be a loss of production and therefore a reduction of efficiency as it would require a second pass to remove that which had not been removed in the first pass. The preferred embodiment of the present invention uses two or more jetting heads 6. In an alternative embodiment, a single jetting head 6 may be used in place of multiple jetting heads 6.

In order to ensure that the adjustment of the jetting heads 6 is correct and to avoid excessive overlap or gap between the jetting heads, the present invention allows for the precise control of the positioning of the jetting heads 6. In the shroud 4, the jetting head apertures 24 through which the jetting heads 6 are mounted are shaped such that the jetting heads 6 may be moved about the axis of their respective jetting head mounting studs 22. This allows for the adjustment of the distance between the centers of each jetting head 6 and therefore the distance between the patterns of the cleaning or coatings removal. Other types of jetting heads which may be mounted within or upon the shroud 4 may require different methods of mounting in order to provide for the necessary adjustment of the jetting heads 6.

It is necessary for the distance from the jetting heads 6 to the plane of the surface to be cleaned to be adjustable so that the user of the device can either clean the surface or completely remove any coatings that may be adhered to the substrate. It is a function of the jet stream that the effective kinetic energy that is delivered to the surface decreases proportionately according to the square of the distance away from that surface. A pair of adjustments controls the distance from the jetting heads 6 to the surface to be cleaned. First, all of the central casters 14 are mounted on threaded central caster studs 16 mounted within central caster nuts 20. This allows for the adjustment of the distance between the base of the shroud 4 and the surface to be cleaned. A second method for adjustment is the jetting head studs 22 upon which the jetting heads 6 are mounted. These threaded studs 22 allow for the adjustment of the distance between the jetting heads and the surface to be cleaned. These two adjustments allow the jetting heads 6 to be placed in a range from contact with the surface to several inches from the surface.

Arranged around the perimeter of the shroud is a plurality of perimeter caster tabs 28 for perimeter casters 30 which assist in guiding the shroud 4 as it is moved along the surface to be cleaned. The placement of the perimeter casters 30 around the circumference of the shroud 4 is also necessary to assist in guiding the device when first placing it in contact with the surface. In the preferred embodiment, the perimeter casters 30 are rollable wheels. In an alternative embodiment, skids are used for the perimeter casters.

The perimeter of the bottom edge of the shroud 4 is provided with a brush 32 which is fastened to the shroud 4 by holding plates 34. The brush 32 reduces the amount of jet spray or mist which is released from beneath the sides of the shroud. This reduction of spray mist increases visibility in the work area and therefore increases the efficiency and safety of the overall jet cleaning process. The brush 32 also serves as a partial seal which allows a controlled amount of air to enter the shroud 4 when a vacuum is attached to the device's drain 8. The brush 32 serves as a water seal for the operation of the device without a vacuum attachment and assists in directing the waste stream produced by the jets to the drain 8.

Figure 4:
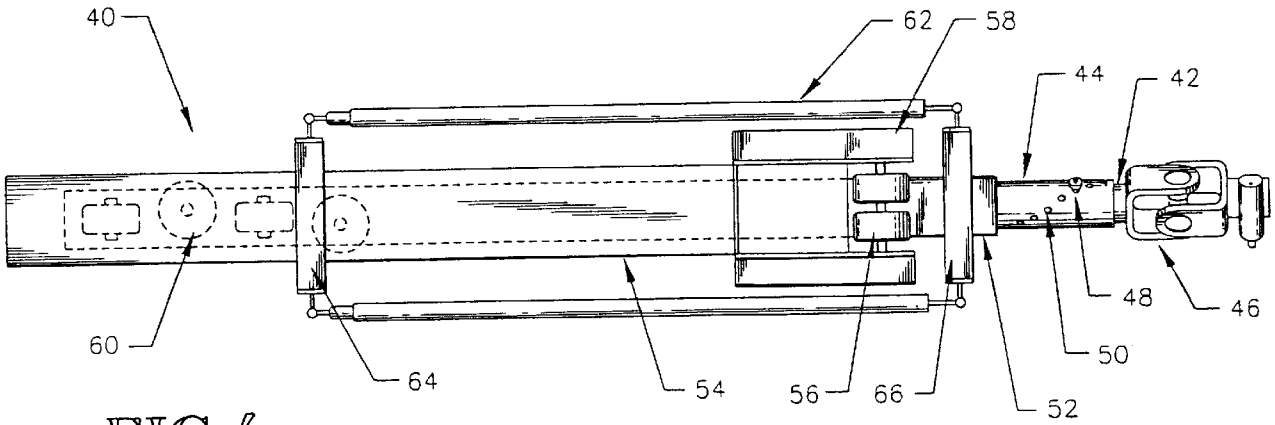
FIG. 4 is a side view of the telescoping ram of the jet cleaning device of present invention.
Figure 5:
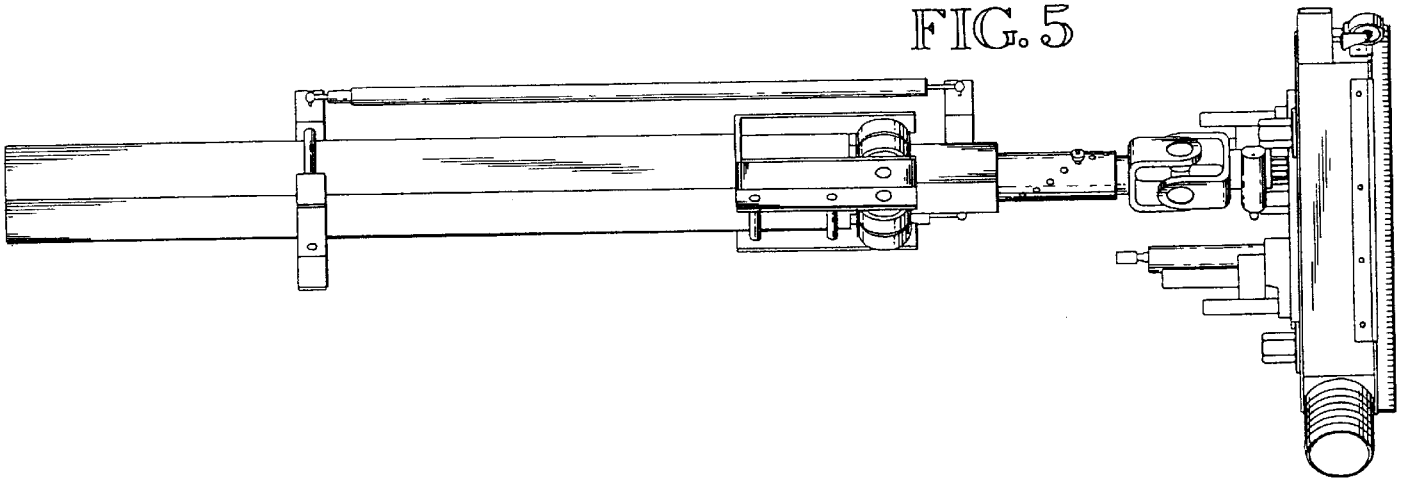
FIG. 5 is a partial orthogonal view of the jet cleaning device of the present invention showing the combination of the cleaning head and ram assembly.

Referring now to FIGS. 4 and 5, the extendible ram 40 consists of a two piece adjustable collar, inner collar 42 and outer collar 44 which allows for the rotation of the gimbal mechanism 46 which can be locked in place by means of a pin 48 inserted through locking holes 50. Inner telescoping tube 52 moves within the outer telescoping tube 54 and is supported by external bearings 56 which provided for low friction movement of the inner telescoping tube 52. The telescoping tubes are preferably manufactured from square cross sectional tubing as it reduces rotational movement of the inner telescoping tube 52 within the outer telescoping tube 54. Other tube geometries are possible as long as the problem of inner telescoping tube 52 rotation is mitigated. In the preferred embodiment, the extendible ram 40 is a telescoping mechanism. Other types of extension mechanisms are envisioned, including an articulated arm.

In order to ensure the smooth movement between the inner telescoping tube 52 and the outer telescoping tube 54 a series of bearings are utilized. The external bearings 56 are mounted on external bearing bracket 58 and the internal bearings 60 are mounted within inner telescoping tube 52. In the preferred embodiment the bearings 56 and 60 are wheels made from a high molecular weight plastic. Extension compensators 62 are attached to internal telescoping tube 52 and outer telescoping tube 54 by means of forward compensator mounting bracket 64 and rear compensator mounting bracket 66.

The placement of the pivot point, which in this case is a splined shaft 12, for the gimbal mechanism 46 is critical in that the force of the jetting heads 6, the weight of the shroud 4 with the jetting heads 6 in place, and the force exerted by the ram mechanism 40, see FIG. 4 and FIG. 5, must be in equilibrium. If the forces are not in equilibrium, the shroud 4 and therefore the jetting heads 6 will lift from the surface to be cleaned and the distance from the jetting heads 6 to the surface will not remain constant. If this distance is not constant, then the efficiency of the device is reduced. Also, if the forces are not in equilibrium, the device will not be capable of following the contours of the surface to be cleaned.

The telescoping ram 40 functions both as a support structure and positioning mechanism for cleaning head 2. The ram 40 may be mounted horizontally upon the rails of a manlift using any number of well known securing mechanisms including a simple clamp. The present invention may also be mounted vertically upon a self propelled vehicle for cleaning or removing coatings on overhead surfaces.

The extension compensators 62 automatically compensate for any change in the distance between the manlift or cart and the surface to be cleaned. The amount of compensation possible is equal to the difference between the compressed and the uncompressed length of the ram 40. The extension compensators 62 may include springs or charged gas cylinders which provide a given compensating force. The selection of the compensating force is a function of the force required to maintain contact of the central casters 14 with the surface to be cleaned. An air cylinder in which the air pressure can be adjusted by means of a regulated valve, a coil spring, or some other type of mechanical spring could also be used in this application.

While outer telescoping tube 54 is attached to the manlift or self propelled cart, the inner telescoping tube 52 glides on the internal and external bearings 60, 56 and is moved forward by the force of the extension compensators 62. The gimbal mechanism 46 allows the cleaning head to pivot about its central mounting point (the splined shaft 12 in FIG. 1) which in turn allows the jetting heads 6 to remain perpendicular to the surface to be cleaned.

From the foregoing teachings, it can be appreciated by one skilled in the art that a new, novel, and nonobvious jet cleaning device has been disclosed. This device allows for the precise control of the standoff distance and the nozzle pass rate. It is to be understood that numerous alternatives and equivalents will be apparent to those of ordinary skill in the art, given the teachings herein, such that the present invention is not to be limited by the foregoing description but only by the appended claims.

I claim:

1. A cleaning head for a surface tracking jet cleaning device comprising:

a) a shroud having a top surface and sidewalls, said sidewalls defining an internal cavity;

b) a first jetting head, for producing a high pressure liquid jet spray, mounted to said top surface within said internal cavity such that the jet spray produced by said first jetting head will exit the said internal cavity; and c) a plurality of casters mounted on, and disposed within the internal cavity defined by, said shroud such that the distance between said first jetting head and a surface to be cleaned can be adjusted.

2. The cleaning head of claim 1, wherein said first jetting head is adjustably mounted to said top surface of said shroud.

3. The cleaning head of claim 1, further comprising:

a second jetting head, for producing a high pressure liquid jet spray, mounted to said top surface within said internal cavity such that the jet spray produced by said second jetting head will exit said internal cavity.

4. The cleaning head of claim 3, wherein said first and second jetting heads are adjustably mounted to said top surface of said shroud.

5. The cleaning head of claim 1, further comprising:

a brush mounted along the perimeter of and extending below a bottom edge of said sidewalls.

6. The cleaning head of claim 1, further comprising:

a drain port extending from one of said sidewalls and in communication with said internal cavity via an aperture in one of said sidewalls.

7. The cleaning head of claim 1, further comprising:

a plurality of perimeter caster tabs extending radially outwardly from said sidewalls; and a plurality of perimeter casters mounted on said perimeter caster tabs.

8. The cleaning head of claim 1, wherein said casters are adjustable to vary the elevation of said cleaning head relative to a surface to be cleaned.

* * * * *